US006817920B1

(12) United States Patent
Furuta et al.

(10) Patent No.: US 6,817,920 B1
(45) Date of Patent: Nov. 16, 2004

(54) DISCHARGE LAMP HAVING AN ELECTRODE WITH SUPPRESSION OF END PORTION DEFORMATION, DISCHARGE LAMP ELECTRODE AND METHOD FOR PRODUCING SAME

(75) Inventors: Shinobu Furuta, Shiga-ken (JP); Yoshitaka Kurimoto, Takatsuki (JP); Kazuhisa Tanaka, Katano (JP); Tatsuya Taniwaki, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 464 days.

(21) Appl. No.: 09/688,970

(22) Filed: Oct. 16, 2000

(30) Foreign Application Priority Data

Oct. 20, 1999 (JP) ..... 11-297773

(51) Int. Cl.[7] ..... H01J 9/04
(52) U.S. Cl. ..... 445/58
(58) Field of Search ..... 445/48, 46, 35, 445/49, 50, 51, 217, 628, 631; 313/270, 271, 576, 574, 628, 631, 633, 344, 575, 217; 140/71.5, 71.6

(56) References Cited

U.S. PATENT DOCUMENTS

| | | | | |
|---|---|---|---|---|
| 2,687,489 A | * | 8/1954 | Anderson | 313/344 |
| 3,619,699 A | | 11/1971 | White | |
| 4,291,444 A | * | 9/1981 | McCarty et al. | 140/71.5 |
| 4,724,358 A | | 2/1988 | Inukai | 313/628 |
| 4,847,534 A | | 7/1989 | der Kinderen | |
| 5,001,397 A | | 3/1991 | der Kinderen | |

FOREIGN PATENT DOCUMENTS

| | | | | |
|---|---|---|---|---|
| DE | 3305468 | | 8/1984 | |
| EP | 273505 | | 9/1987 | |
| EP | 273505 | | 7/1988 | |
| EP | 579429 | | 1/1994 | |
| EP | 910111 | | 4/1999 | |
| EP | 917180 | | 5/1999 | |
| JP | 3826740 | | 9/1963 | |
| JP | S54-091972 | | 7/1979 | |
| JP | 58005944 | * | 1/1983 | 445/35 |
| JP | 58102431 | | 6/1984 | |
| JP | S62-047941 | | 3/1987 | |
| JP | 63313463 | * | 12/1988 | 445/48 |
| JP | H02-299148 | | 12/1990 | |
| JP | 08-069750 | | 3/1996 | |

* cited by examiner

*Primary Examiner*—Joseph Williams

(57) ABSTRACT

A discharge lamp electrode, a discharge lamp for which the electrode is used, and a method for producing a discharge lamp electrode with increased productivity are disclosed. With the disclosed discharge lamp electrode, deformations in its end portion are suppressed, so that the electrode life is extended. For the discharge lamp electrode 106, tungsten wires are wound around an electrode rod 111 in the same turning direction and form a first-layer coil 112 and a second-layer coil 113. A tungsten wire forming the second-layer coil 113 is wound along a spiral valley between adjacent turns in the first-layer coil 112.

8 Claims, 5 Drawing Sheets

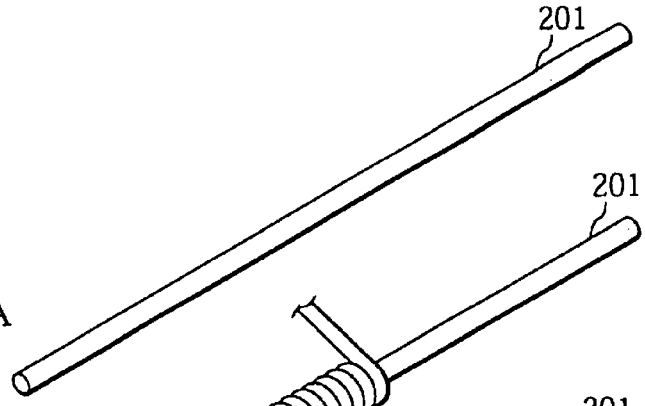
Fig. 5A
Fig. 5B
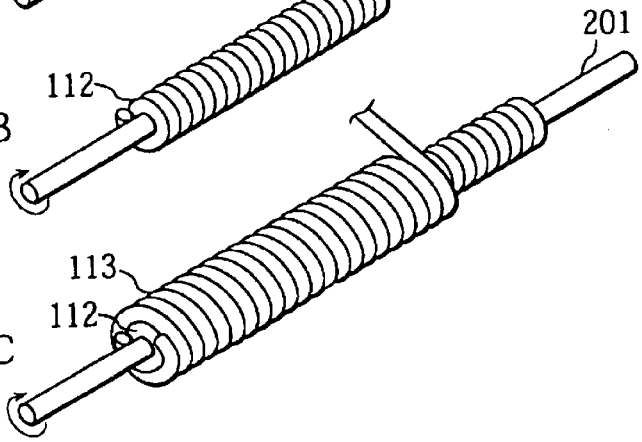
Fig. 5C
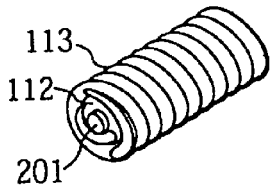
Fig. 5D
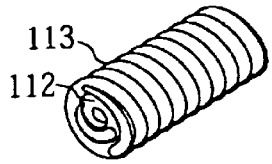
Fig. 5E
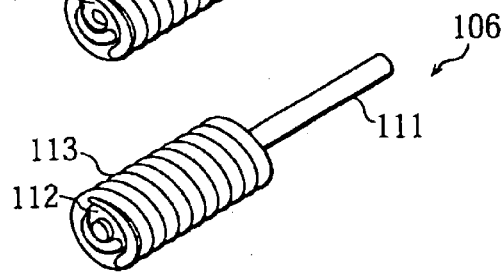
Fig. 5F

DISCHARGE LAMP HAVING AN ELECTRODE WITH SUPPRESSION OF END PORTION DEFORMATION, DISCHARGE LAMP ELECTRODE AND METHOD FOR PRODUCING SAME

This application is based on application No. 11-297773 filed in Japan, the content of which is hereby incorporated by reference.

BACKGROUND OF THE INVENTION (1) Field of the Invention

The present invention relates to a discharge lamp, an electrode used for a discharge lamp, and a method for producing an electrode.

(2) Description of the Prior Art

A conventional discharge lamp electrode is disclosed in the "publication of examined utility model application" No. 38-26740 in Japan, for instance. FIG. 1A shows a conventional discharge lamp electrode. As shown in the figure, the discharge lamp electrode 900 is formed by winding a single wire 902 around an electrode rod 901 so that the wire 902 forms a double-layer coil construction composed of a first-layer coil 911 and a second-layer coil 912. More specifically, the wire 902 is wound from a predetermined portion of the electrode rod 901 toward a discharge-side end 910 of the electrode rod 901, and then from the discharge-side end 910 back toward the opposite side so that the first-layer coil 911 and the second-layer coil 922 each have an opposite "turning direction". Here, the "turning direction" refers to either a clockwise direction or a counterclockwise direction, in which the wire 902 turns when viewed from an end of the electrode rod 910 from which the wire 902 is wound away. In FIG. 1A shown as an example, the wire 902 forming the first-layer coil 911 is turned clockwise, while the wire 902 forming the second-layer coil 912 is turned counterclockwise.

In this way, the conventional electrode 900 is produced by winding the wire 902 around the electrode rod 901 to form a double-layer coil construction, and cutting the wire 902 to a predetermined length.

However, the conventional electrode 900 has the following problems.

First, as can be understood from FIG. 1B which is a front view of the discharge-side end 910 of the electrode 900, the electrode 900 contains a portion, where the above turning direction changes, that has a single-layer coil construction.

Second, for the conventional electrode 900, interstices exist between the first-layer coil 911 and the second-layer coil 912, so that a heat capacity of an end portion of the electrode 900 becomes insufficient. This raises a temperature of the end portion, and therefore the end portion becomes liable to melt and vaporize, and eventually electrode substances are scattered inside a light-emitting tube. This causes wall blackening inside the light-emitting tube and degrades luminance of light emitted from the light-emitting tube at an earlier stage of use of the lamp.

Thirdly, when the discharge-side end 910 melts and gets deformed, the second-layer coil 912 gradually moves toward the discharge-side end 910, and is melt and scattered in accordance with an increase in a temperature of the discharge-side end 910. This further intensifies blackening inside the light-emitting tube.

Development of a downsized projector with a liquid crystal panel has been continued. This therefore requires a discharge lamp, which is used as a light source of such projector, to have a shorter arc. A shorter arc results in increasing the temperature of the end portion of the electrode 900, but a longer life is still required for such discharge lamp. Accordingly, development of a discharge lamp electrode that can satisfy these needs is now urgently demanded.

SUMMARY OF THE INVENTION

The present invention aims to provide a discharge lamp electrode whose end portion deformations are suppressed so that the electrode has a longer life, a discharge lamp for which the electrode is used, and a method for producing an electrode for a discharge lamp with increased productivity.

The above object can be achieved by a discharge lamp electrode used for a discharge lamp. The electrode includes: an electrode rod made of refractory metal; and a winding element made of refractory metal wires that are wound around the electrode rod in a same turning direction and that forms n layers of coils, n being larger than one, wherein a wire forming an (m+1)th layer is wound along a spiral valley between adjacent turns in a coil of an mth layer, m satisfying an inequality $0<m<n$, an ordinal number given to each layer representing an order in which a coil of the layer has been formed.

For this construction, a wire forming the (m+1)th layer of a coil is wound along a spiral valley between turns in a coil of the mth layer. This construction prevents the outer layer of the coil from moving toward the discharge side when an end of the electrode melts or vaporizes to be deformed due to an increase in a temperature of the electrode end while the light is lit. As a result, further deformations at the electrode end can be suppressed, and therefore a life of a discharge lamp is extended.

The method for producing a discharge lamp electrode according to the present invention is characterized by including: a winding step for winding at least one refractory metal wire around a core member and forming n layers of coils one by one, n being larger than one; a cutting step for cutting the formed n layers of coils and the core member; a removing step for removing the core member after the cutting step; a rod inserting step for inserting an electrode rod into a space from which the core member has been removed, the electrode rod being made of refractory metal; and a fixing step for fixing the formed n layers of coils to the inserted electrode rod.

With this method, metal wires do not have to be wound around each electrode rod to form layers of coils for each electrode, so that productivity of electrodes can be improved.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIGS. 5A-5F are drawings that describe a method for producing the electrode of the above embodiment.

DESCRIPTION OF THE PREFERRED EMBODIMENTS

The following describes embodiments of the present intention with reference to drawings.

First Embodiment (1) Construction of a Discharge Lamp

Figure 1A:
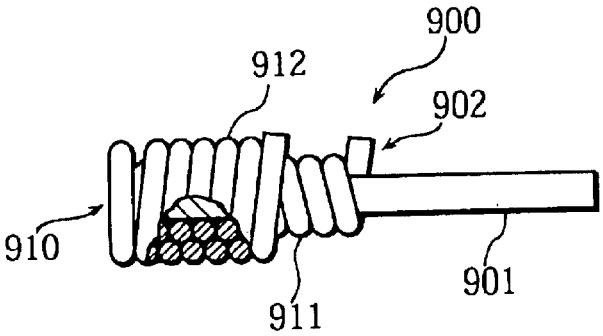
FIG. 1A shows an example construction of a conventional discharge lamp electrode, part of which is shown as a cross-sectional view.
Figure 1B:
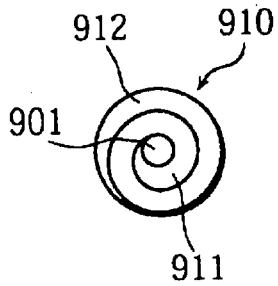
FIG. 1B shows an example construction of the conventional electrode in front view.
Figure 2:
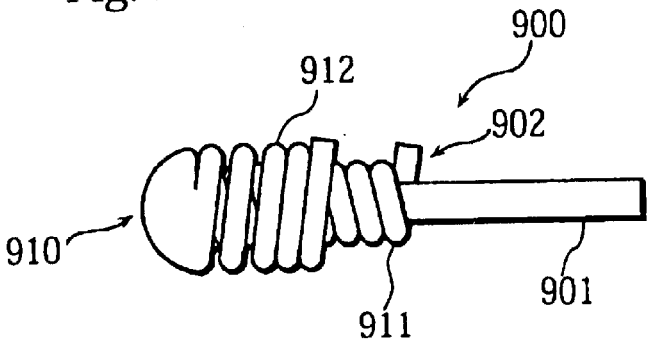
FIG. 2 is a drawing that explains problems involved in the conventional discharge lamp electrode.
Figure 3:
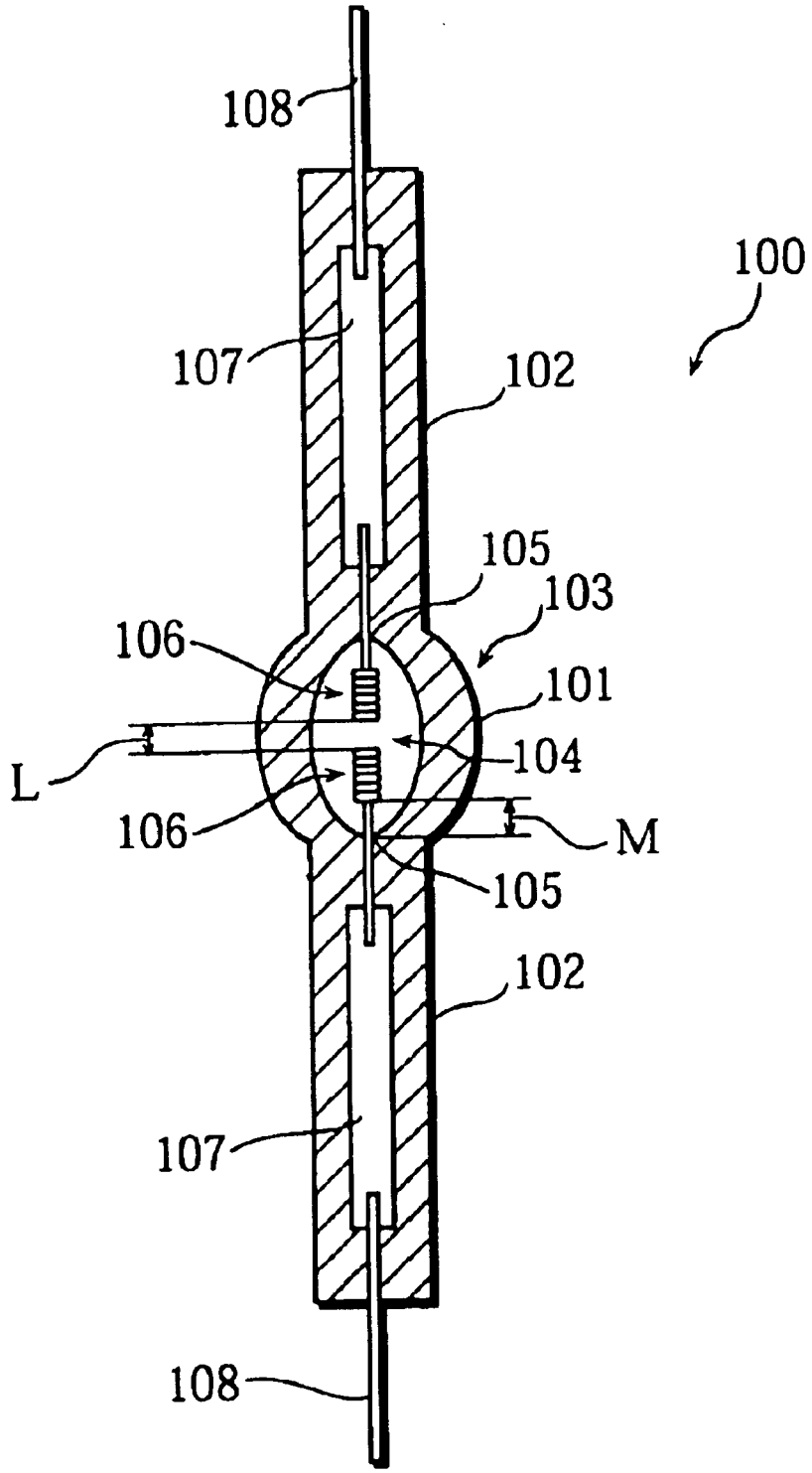
FIG. 3 is a cross-sectional view of an example construction of a discharge lamp according to the first embodiment of the present invention.

FIG. 3 is a cross-sectional view of an example construction of a discharge lamp according to the present embodiment. This discharge lamp 100 is a so-called high pressure mercury lamp used as a light source of a projector and the like, and has a rated power of, for instance, 220 W. It should be clear that a discharge lamp with a different rated power from the above has basically the same construction as shown in FIG. 3 although dimensions of its parts may be different from the discharge lamp 100.

The discharge lamp 100 has a light-emitting tube 103 which is 70 mm long. The light-emitting tube 103 is composed of a light-emitting part 101 having the largest outside diameter of 13 mm, and two sealing parts 102 positioned at both ends of the light-emitting part 101. Inside the light-emitting part 101, two electrodes 106, whose major constituent is tungsten, are extended from ends of the sealing parts 102. Coldest spots 105 are present at these ends of the sealing parts 102.

Discharging-side ends 120 of the two electrodes 106 face each other, with a distance ("L" in the figure, with this distance "L" hereafter being called an "arc length") of 1.7 mm being maintained between the two. Emitting space 104 is 12 mm and 7 mm in inside diameters, with the former corresponding to the major axis and the latter to the minor axis. Argon, mercury as a light-emitting substance, and halides, such as $CH_2Br_2$, of a predetermined quantity are filled into the emitting space 104. Per cubic millimeter of the emitting space 104, 0.17 mg mercury is filled. The argon is filled at a pressure of 20 kPa at a room temperature. Ends of the two electrodes 106 on the opposite side of the discharge side are connected via metal foil conductors 107 made of molybdenum to outer lead wires 108.

(2) Construction of Electrode in Discharge Lamp

Figure 4:
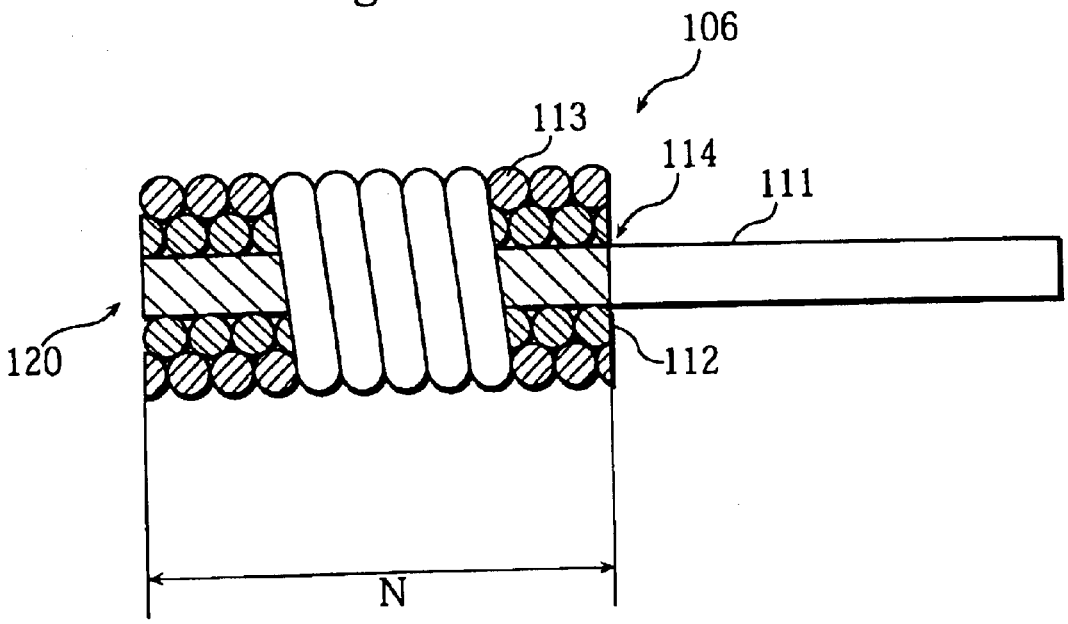
FIG. 4 shows a construction of the electrode of the same embodiment, part of which is shown as a cross-sectional view.

FIG. 4 shows a construction of each electrode 106, part of which is shown as a cross-sectional view. The electrode 106 has a double-layer coil construction composed of a first-layer (inner) coil 112 and a second-layer (outer) coil 113, which are made by different tungsten wires of a diameter of 280 $\mu$m wound around the electrode rod 111 of an outside diameter of 400 $\mu$m. Ends 114 of the two coils 111 and 112 are welded onto the electrode rod 111 on the opposite side of a discharge-side end 120. The first-layer coil 112 and the second-layer coil 113 each have eleven turns, with every turn being made in the same turning direction for the present embodiment. The first-layer coil 112 and the second-layer coil 113 are wound so as not to leave any gaps between adjacent turns in the same layer of a coil.

The first-layer coil 112 and second-layer coil 113 are made by different tungsten wires, which allows the two coils 112 and 113 to have turns of the same turning direction. The two coils 112 and 113 are wound with the same pitch, and the wire forming the second-layer coil 113 is wound around indentations formed by adjacent turns of the first-layer coil 112. This construction prevents the second-layer coil 113 from moving toward the discharge-side end 120 even when the discharge-side end 120 is melt and vaporized to be deformed. Note that the two wires that form the first-layer coil 112 and the second-layer coil 113 may have different diameters, as will be described later, although for the present embodiment, the two have the same diameter.

(3) Methods for Producing Electrodes and Discharge Lamp

The following describes a method for producing the electrode 106 and the discharge lamp 100 of the present embodiment with reference to FIGS. 5A-5F.

First, a core member 201, which is made of molybdenum and has the same diameter (400 $\mu$m for the present embodiment) as the electrode rod 111, is prepared as shown in FIG. 5A. A tungsten wire in a diameter of 280 $\mu$m is wound around the core member 201 as shown in FIG. 5B. This wire forms the first-layer coil 112. In FIG. 5B, the core member 201 is turned in a direction shown by an arrow to have the wire wound around the core member 201. However, a method to have the wire wound around the core member 201 is not limited to this, and it is alternatively possible, for instance, to fix the core member 201 and wind the wire around the core member 201. The total number of turns made by this wire may be determined in accordance with a number of electrodes 106 to be manufactured.

After the first-layer coil 112 has been made in this way, another wire to form the second-layer coil 113 is wound, as shown in FIG. 5C, around the first-layer coil 112 with the same pitch and in the same turning direction as used for the first-layer coil 112. This wire of the second-layer coil 113 is wound around indentations formed by adjacent turns of the first-layer coil 112 shown in FIG. 4. After the second-layer coil 113 has been made in this way, the whole structure is heated at an elevated temperature of about 1,500 degrees centigrade to remove distortion of the two wound coils 112 and 113 (hereafter collectively called a coil) and stabilize their shapes.

After this, the above structure is cut to a predetermined length "N" for one coil, as shown in FIG. 5D. This cut may be performed by, for instance, with a cutter, a laser, or the like. With this method of winding tungsten wires around the core member 201 and cutting it to a predetermined length, variations in a length of a coil can be eliminated, and it become easy to provide an equal length "M" (see in FIG. 3) between an end 114 (see FIG. 4) of the electrode 106 and the coldest spot 105 (see FIG. 3) to different discharge lamps. This suppresses variations in the coldest spot temperature of each manufactured discharge lamp, and stabilizes luminous characteristics of discharge lamps. This is effective especially for a lamp, such as a metal halide lamp, that uses a light-emitting substance whose spectrum characteristics change in accordance with a temperature.

After the above structure has been cut to the predetermined length "N", the core member 201 is removed from the structure as shown in FIG. 5E. As stated earlier, the core member 201 is made of molybdenum. This is not only because the molybdenum resists the above heat process but also because the molybdenum dissolves in a certain liquid, such as aqua regia, that does not dissolve tungsten. This facilitates the removal process in FIG. 5E. However, it should be clear that the core member 201 may be made of substances other than the molybdenum.

After the removal process in FIG. 5E, the whole coil may be washed if necessary. Following this, as shown in FIG. 5F, the electrode rod 111 made of tungsten is inserted into the space from which the core member 201 was removed. The end 114 of the coil is welded and fixed onto the electrode rod 111 by performing resistance welding, for instance. It should be clear that a position on which the resistance welding is performed is not limited to the above end 114 of the coil, and likewise a method for fixing the coil to the electrode rod 111 is not limited to the resistance welding.

The above method allows the electrode 106 to be produced easily and increases its productivity because a wire do not have to be wound around each electrode rod separately. A discharge lamp can be provided when the above electrodes 106, light-emitting substances, and other necessary substances are sealed inside a glass valve (not shown in the figure).

Note that the above manufacturing method may be applied to an electrode other than the electrode 106 of the present embodiment. This is to say, the present method may be applied to an electrode for which wires forming two layers of coils (i.e., a first-layer coil and a second-layer coil) are wound in the opposite turning directions to increase productivity. Such electrode can be used for a discharge lamp, such as a lamp with a longer arc, in which a temperature of end portions of two facing electrodes does not rise too high.

Also note that the above method may be used for producing electrodes used in a variety of lamps other than a high pressure mercury lamp although the present embodiment uses the high pressure mercury lamp 100 as one example of a discharge lamp.

(4) Results of Lamp Life Test

The following describes results of a lamp life test, for which twenty of high pressure mercury lamps 100 (hereafter, called "invention's lamps") and the same number of conventional high pressure mercury lamps-are prepared. The invention's lamps and the conventional lamps have basically the same construction, except that the conventional lamps contain electrodes that differ from the electrodes 106 of the present invention. Each lamp is placed inside a reflecting mirror with front-mounted glass, and lit up with an alternating current to obtain an "illuminance maintenance factor" for the two types of lamps. Here, the "illuminance maintenance factor" is represented by a percentage, with an illuminance of a light immediately after being lit as 100%. Table-1 below shows illuminance maintenance factors obtained by the lamp life test.

As is clear from Table-1, the invention's lamps have illuminance maintenance factors of 80% and 75% when 1,000. and 2000 hours respectively have passed since the time at which lamps are lit. When 2,000 hours have passed, blackening did not still occur inside a light-emitting type 103 of each invention's lamp. In addition, it was visually observed that a second-layer coil 113 did not moved.

TABLE 1

| | Illuminance Maintenance Factor (%) Elapsed Time (hours) | | |
|---|---|---|---|
| | 100 | 1000 | 2000 |
| Invention's Lamp | 90 | 80 | 75 |
| Conventional Lamp | 70 | 50 | — |

On the other hand, conventional lamps have illuminance maintenance factors of 70% when 100 hours have passed since the time at which the lamps are lit up. As early as at this point, occurrence of blackening was visually observed inside light-emitting tubes of conventional lamps, and second-layer coils had partially moved toward the discharging side. When 1,000 hours have passed, the conventional lamps have an illuminance maintenance factor of 50%. When 2,000 hours have passed, the conventional lamps had gone out. Accordingly, this life test has proved that the use of the electrodes 106 of the present invention for a discharge lamp extends a life of the discharge lamp.

(5) Consideration of Improvement in Lamp Life

The following describes reasons why the above results were obtained. First, tungsten wires forming the first-layer coil 112 and the second-layer coil 113 are wound around the electrode 106 in the same turning direction, and these wires are separate wires. As a result, the electrode 106 contains no portions that has a single-layer coil construction. In addition, the wires forming the first-layer coil 112 and the second-layer coil 113 are wound with no interstices between the two layers, so that a sufficient heat capacity can be provided for the discharge-side end 120. of the electrode 106. It can be analyzed that this sufficient heat capacity prevents a temperature around the discharge-side end 120 from rising to higher than necessary and suppresses melting of the discharge-side end 120.

Further, with the present electrode 106, the wire of the second-layer coil 113 is wound around indentations between adjacent turns formed by the wire of the first-layer coil 112, and the same turning direction is used for the first-layer coil 112 and the second-layer coil 113. This suppresses movements of the second-layer coil 113 toward the discharge-side end 120, so that should the discharge-side end 120 be deformed to an extent, an electrode substance is not melted and scattered further. As a result, a life of the discharge lamp 100 can be extended.

(6) Considerations of Arc Length between Two Electrodes

The degree of scattering of an electrode substance largely depends on an arc length "L" between the two electrodes 106. This is because when lamps of the same rated power are compared, larger currents flow thorough electrodes 106 in a lamp with a shorter arc, and therefore a temperature of the electrodes 106 rises.

As a result, with a conventional lamp whose arc length is shorter than 2.5 mm, end portions of electrodes are melt and scattered and blackening occurs inside a light-emitting tube before 100 hours pass since the light of the lamp was lit.

In contrast, blackening did not occur to the invention's lamps having an arc length shorter than 2.5 mm during the above lamp life test.

Making an arc length between two electrodes shorter than 2.5 mm is preferable for an optical device into which a discharge lamp and a reflecting mirror are combined. This is because due to a shorter arc length, a displacement of a focal point of the reflecting mirror from a center of the arc length becomes smaller, so that reflective efficiency can be improved. This is to say, a shorter arc length (excluding 0 mm) is preferable for a lamp to be contained in an optical device like the above, and the present invention can provide a lamp that has a shorter arc length and that can still maintain a longer life.

Second Embodiment

The following describes a case in which electrodes of the present invention are applied to a high pressure mercury lamp of a rated power of 100 W and this high pressure mercury lamp is tested for the shortest possible arc length.

The high pressure mercury lamp of the present embodiment has the same construction as in the first embodiment shown in FIG. 3, but it has different dimensions. This is to say, a light-emitting unit 103 of the present high pressure mercury lamp is 55 mm long and has the largest outside diameter of 9 mm, and the arc length is first set as 1.0 mm. A density of mercury and a pressure of argon filled in the light-emitting unit 103 is the same as in the first embodiment.

Electrodes 106 of the present embodiment have a double-layer coil construction as shown in FIG. 4. An electrode rod 111 has an outside diameter of 300 μm. Tungsten wires are wound to form a first-layer coil 112 and a second-layer coil 113 without leaving no gaps between turns in each layer of a coil. Each wire has a diameter of 175 μm.

The present high pressure mercury lamp was lit to be tested while the arc length was shortened to up to 0.8 mm. The test result proved that no blackening occurs to the present high pressure mercury lamp. Generally, variations in an arc length is ±0.2 mm, and therefore lamps with an arc length of 0.6 mm may exist in a lamp lot. Accordingly, a high pressure mercury lamp containing the electrodes 106 positioned with the arc length of 0.6 mm was also tested, and no blackening was observed for this mercury lamp also.

Example Modifications

The present invention has been described based on the above embodiments, however, it should be clear that the present invention is not limited to specific examples described in the above embodiments. Possible example modifications are described below.

(1) The above embodiments state that the electrode 106 has a double-layer coil construction composed of the first-layer coil 112 and the second-layer coil 113. However, a number of layers of coils is not limited to two, and may be a higher number.

Figure 6A:
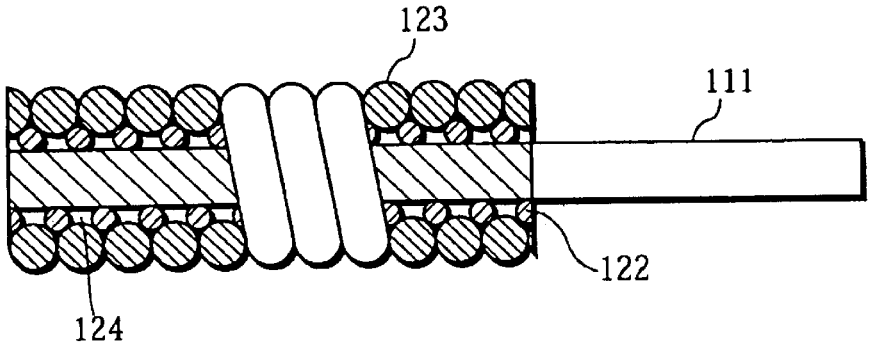
FIGS. 6A-6B show example constructions of discharge lamp electrodes, parts of which are shown as cross-sectional views, as modifications of the present invention.

(2) In the above embodiments, wires forming the first-layer coil 112 and the second-layer coil 113 have the same diameter of 280 μm. However, the diameter of the first-layer coil 112 and the second-layer coil 113 may not be 280 μm, or the two may have different diameters. For instance, the second-layer coil 113 of a larger diameter may be wound around the first-layer coil 112 of a smaller diameter in a manner that leaves space 124 between adjacent turns as shown in FIG. 6A. An emitter material then can be filled into this space 124. Instead of forming space 124 between the electrode rod 111, and the first-layer coil 122 and the second layer coil 123 in this way, it is possible to form space using three layers of coils. This can be achieved, for instance, by winding three layers of coils composed of "p−1", "p", and "p+1", in a manner that leaves a gap between adjacent turns of a coil "p" and that coils "p−1" and "p+1" are wound above each gap. When the three coils "p−1", "p", and "p+1" have diameters "P−1", "P", and "P+1", respectively, expressions "P<P−1" and "P<P+1" need to be satisfied.

Figure 6B:
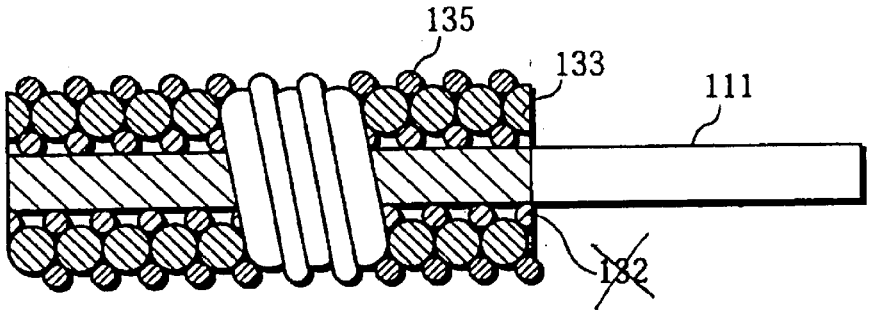

It is alternatively possible, as shown in FIG. 6B, to wind a third (outermost)-layer coil 135 of a smaller diameter around the second-layer coil 133 of a larger diameter so as to adjust a heat capacity. By winding a coil of a smaller diameter around indentations between turns of a coil of a larger diameter in this way, no interstices are left between the two layers of coils although the coil of the smaller diameter is not necessarily wound without leaving no gaps between adjacent turns of the coil. When the two coils are wound closely in this way, a sufficient heat capacity can be obtained. Such an electrode can be easily produced according to the electrode production method of the above embodiment.

(3) In the above embodiments, a cross-sectional shape of tungsten wires is substantially circular. Note that it is preferable to use a wire of a circular cross-sectional shape for all the coils, except for an outermost layer of a coil, so as to have each coil wound as closely as possible even when a total number of layers of coils is increased, or wires of different diameters are used as in the above example modifications. It is alternatively possible to use a wire of a different cross-sectional shape to form each layer of a coil. The electrode production method of the present invention can be used for producing an electrode formed with such wires of different cross-sectional shapes.

(4) The above embodiments use high pressure mercury lamps with rated powers of 220 W and 100 W to describe the present invention. However, an electrode of the present invention may be used for a discharge lamp with a rated power other than the above, or a discharge lamp of other types, such as a low pressure lamp and high pressure lamps including a sodium lamp and a metal halide lamp.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A method for producing an electrode used for a discharge lamp, including:

a winding step for winding at least one refractory metal wire around a core member and forming n layers of coils one by one, n being larger than one;

a cutting step for cutting the formed n layers of coils and the core member;

a removing step for removing the core member after the cutting step;

a rod inserting step for inserting an electrode rod into a space from which the core member has been removed, the electrode rod being made of refractory metal; and a fixing step for fixing the formed n layers of coils to the inserted electrode rod.

2. The method of claim 1, wherein in the winding step, a refractory metal wire forming an (m+1)th layer is wound along a spiral valley between adjacent turns in a coil of an mth layer, m satisfying an inequality 0<m<n, an ordinal number given to each layer representing order in which a coil of the layer has been formed and wherein refractory metal wires forming the (m+1)th layer and the mth layer are wound in a same turning direction.

3. The method of claim 1, further including a shape stabilizing step for stabilizing a shape of the n number of layers of coils, wherein the shape stabilizing step is performed between the winding step and the cutting step.

4. The method of claim 1, wherein the removing step is performed by immersing the core member, around which the n number of layers have been formed, into a liquid that dissolves the core member but does not dissolve each refractory metal wire.

5. The method of claim 4, wherein the core member is made of molybdenum, and each refractory metal wire is made of tungsten.

6. A method for producing a discharge lamp with electrodes formed by the steps of:

a winding step for winding, with the same pitch, refractory metal wires around a core member and forming n layers of coils one by one, n being larger than one;

a shape stabilizing step for stabilizing a shape of the n number of layers of coils;

a cutting step for cutting the formed n layers of coils and the core member to provide a flat tip surface;

a removing step for removing the core member after the cutting step;

a rod inserting step for inserting an electrode rod into a space from which the core member has been removed, the electrode rod being made of refractory metal;

a welding step for fixing the formed n layers of coils to the inserted electrode rod; and a fixing step for mounting a pair of identical electrodes within a light emitting tube so that tips of the electrodes are spaced a length less than 2.5 mm from each other.

7. The method of claim 6, wherein the length is approximately 0.6 mm.

8. The method of claim 6 wherein the n layers include a (p−1)th layer, a pth layer, and (p+1))th layer, which are formed by refractory metal wires with diameters of P−1, P, and P+1 respectively, p satisfying an inequality $1<p<n$, inequalities $p<p-1$ and $p<p+1$ being satisfied, and wherein the three refractory metal wires are wound to form spaces that are each surrounded by (a) the (p−1)th layer (b) adjacent turns in a coil of the pth layer, and (c) the (p+1) layer.

* * * * *